United States Patent [19]

Volkmann et al.

[11] 4,455,706

[45] Jun. 26, 1984

[54] PROCESS AND APPARATUS FOR THE REMOVAL OR CONTROLLED REDUCTION OF ADHERENT FILMS OF LIQUID ON HARD SURFACES

[75] Inventors: Jurgen Volkmann, Schwefe; Hans H. Gross, Erkrath, both of Fed. Rep. of Germany

[73] Assignee: Ing. Jurgen Volkmann, GmbH, Schwefe, Fed. Rep. of Germany

[21] Appl. No.: 82,173

[22] Filed: Oct. 5, 1979 (Under 37 CFR 1.47)

[30] Foreign Application Priority Data

Oct. 5, 1978 [DE] Fed. Rep. of Germany ..... 2843449

[51] Int. Cl.[3] ..... A47L 5/38

[52] U.S. Cl. ..... 15/306 A; 15/307; 15/308; 15/374; 15/401; 15/409

[58] Field of Search ..... 15/306 A, 307, 308, 15/374, 401, 409, 415 A

[56] References Cited

U.S. PATENT DOCUMENTS

| | | | |
|---|---|---|---|
| 1,236,359 | 8/1917 | Reynolds | 15/306 A X |
| 1,507,002 | 9/1924 | Roeder | 15/307 |
| 2,610,351 | 9/1952 | Lilly | 15/401 |
| 2,707,874 | 9/1955 | Glover | 15/409 X |
| 3,604,049 | 9/1971 | Hetman | 15/374 X |
| 3,654,659 | 4/1972 | Blumenthal | 15/306 A |
| 4,197,609 | 4/1980 | Führing | 15/306 A |

*Primary Examiner*—Chris K. Moore

*Attorney, Agent, or Firm*—Larson and Taylor

[57] ABSTRACT

A method and apparatus for removing or reducing the amount of an adherent film of liquid on a surface. The apparatus comprises an elongate suction nozzle having a suction inlet and a longitudinal edge which comprises a scraping tool. In use, under-pressure in the suction nozzle is used to press the scraping tool against the surface and simultaneously remove liquid from the surface being scraped.

14 Claims, 3 Drawing Figures

PROCESS AND APPARATUS FOR THE REMOVAL OR CONTROLLED REDUCTION OF ADHERENT FILMS OF LIQUID ON HARD SURFACES

BACKGROUND OF THE INVENTION

The invention relates to a process and apparatus for the removal or controlled reduction of adhesive films of liquid on hard surfaces, especially for the removal or dosing of rolling liquid used in a cold-rolling process.

In various technical fields such as cold-rolling, a film of liquid is employed to carry out certain operating processes such as the natural rolling process on the surface of the goods that are to be processed, which film is subsequently to be either removed completely or else reduced to a controlled, dosed, thickness. Hitherto, wipers or squeezing rolls have been used for this purpose, or else the liquid, particularly oil, was removed by a mechanical process. The use of mechanical members, such as wipers and squeezing rolls, however, turns out to be insufficient with increasing relative speed between the surface and the mechanical members: at high speed, a kind of aquaplaning effect occurs which leads to the lifting off of the mechanical tools. In the case of chemical processes, it is a disadvantage that in that case, the liquid is lost so that such processes are expensive. Many times, such a complete removal as occurs in the case of chemical treatment, is not desirable at all; rather in many cases, a certain residual thickness of the liquid film is to be retained in a precisely distributed uniform thickness.

Moreover, special problems will occur, whenever the processing liquid is easily combustible and consequently may ignite by formation of sparks which can never be avoided, for example, in the case of running up of the edges during rolling.

It is an object of the present invention to provide a process of the type mentioned above as well as an apparatus to carry it out, which assures a controlled removal or a dosed reduction of arbitrary adherent films of liquid on hard surfaces even in the case of high relative speeds between the surface and the means serving for the removal with the simultaneous possibility of recapturing the removed liquid.

BRIEF SUMMARY OF THE INVENTION

The foregoing and other objects which will be apparent to those having ordinary skill in the art are achieved according to the present invention by a mechanical scraping off of the film of liquid with the simultaneous use of under-pressure or vacuum in order to press the scraping tool onto the work surface and simultaneously carry off of the liquid.

DETAILED DESCRIPTION

By the additional use of under-pressure according to the invention during the removal of the liquid film, the scraping tool on the one hand is pressed positively against the surface that is to be cleaned and on the other hand, the removed liquid is carried away in a prescribed path so that it can easily be collected and fed again to its intended use. Thus, the process is economical and at the same time, it protects the environment and avoids to a large extent the danger of uncontrolled combustion in the case of its application to easily flammable liquids.

It is recommended to keep the under-pressure over the range of scraping at least approximately constant in order to maintain as much as possible equal conditions over the entire area of the surface.

Another characteristic for the advantageous development of the process according to the invention provides that the under-pressure is adjustable in order to adapt it to variable speeds of scraping and/or residual thicknesses of the liquid film.

It is particularly advantageous to produce the under-pressure by means of air or gas flow according to the jet nozzle principle. This makes possible the use of conventional producers of compressed air already existing in the manufacturing shops and it is furthermore extremely simple to operate intermittently in agreement with the treatment process. In the case of easily flammable liquids, one may use in this way even oxidation impeding gases, such as nitrogen.

An apparatus for carrying out the previously mentioned process comprises an elongated suction nozzle pointed transversely in relation to the direction of movement and movable in relation to the surface, of which at least one longitudinal edge is developed as a scraping tool.

In this case, both longitudinal edges of the suction nozzle are developed effectively as sealing strips and the longitudinal ends of the suction nozzle have controllable inlet cross sections for the suction flow. With the help of the controllability of these inlet cross sections, it is possible to adjust the under-pressure within the suction nozzle easily to the required value.

An even further reaching development of such an apparatus consists in the fact that the suction nozzle, viewed in top view of the surface to be treated, is V-shaped and is movable in such a way relative to the surface, that the apex of the V-shaped nozzle lags in relation to the ends of the nozzle. As a result of that arrangement, the fact that the air entering at the lateral ends of the suction nozzle requires a certain terminal time until it reaches the apex of the V-shaped nozzle, is taken into account and the liquid existing there on the hard surface is siezed here and is carried away. For the adaptation to variable relative speeds between the surface and the suction nozzle, it may in this case be of particular advantage if the angle between the legs of the V-shaped nozzles is adjustable.

V-shaped nozzles of the previously mentioned type are particularly effective for use in the case of the removal of liquid films from the surface of a rolled material in the case of cold-rolling. In order to adapt to the width of the rolling material which changes frequently from charge to charge, it is particularly advantageous to be able to change the effective length of the legs of the V-shaped nozzle. A particularly advantageous arrangement for doing this is provided in a device in which the legs of the V-shaped nozzle have a circular inside cross section and receive rotating valves with slanting control surfaces: rotation of the valves changes the effective length of the legs.

The invention will be explained subsequently on the basis of an embodiment shown in the drawing in connection with the removal or controlled reduction of the liquid film on cold-rolled material.

Figure 1:
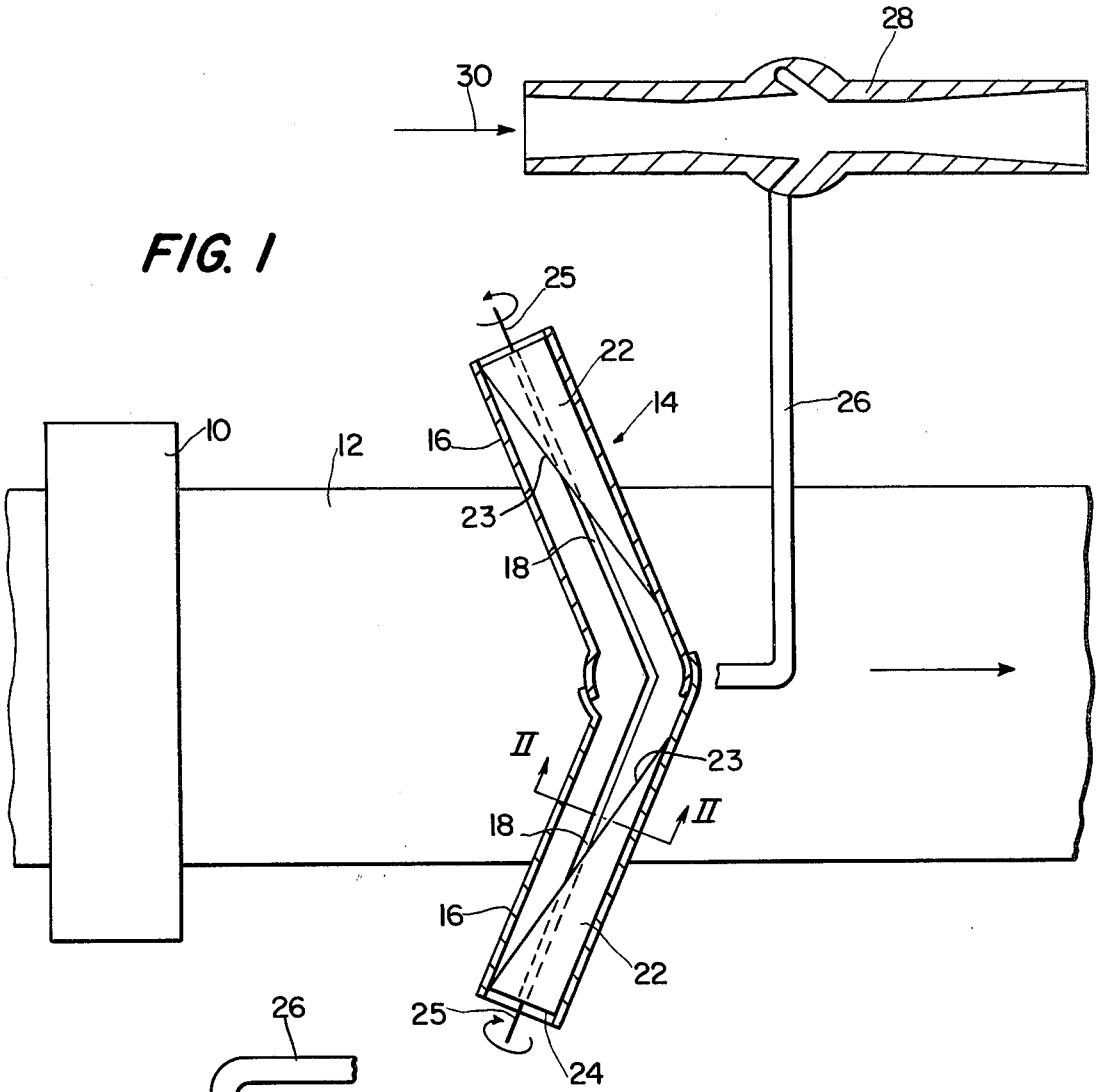
FIG. 1 is a diagrammatic top view of a device in accordance with the invention used in connection with material rolling off a rolling stand.
Figure 3:
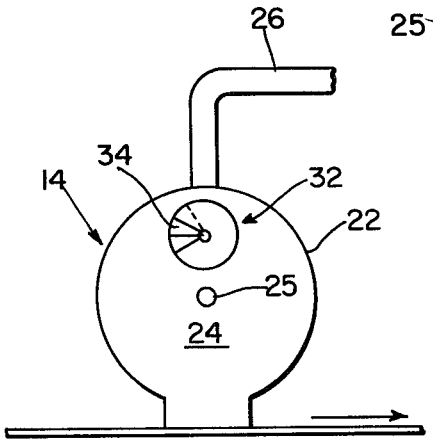
FIG. 3 shows an end elevational view, similar to FIG. 2, of the suction nozzle.

In FIG. 1, the reference number 10 indicates a rolling stand from which the rolling material, bearing a previously applied liquid, runs off in the shape of a sheet 12 at a high speed, for example, 25 m/sec. For the cold-rolling in the rolling stand 10, the metal sheet has been provided previously with a rolling liquid, for example, a lubricant oil with certain additives, which forms an adherent film on the metal sheet which exists in a considerable thickness even after passing through the rolling stand. In case the metal sheet, and particularly in the case of lesser thicknesses of the sheet, is subsequently wound up, the liquid film may cause difficulties; especially, there is the danger that because of a slight amount of its inclusion during the winding up process, the inside wound layers would shoot out in the manner of a telescope to one or the other side and would to a high degree endanger any individuals being there.

Figure 2:
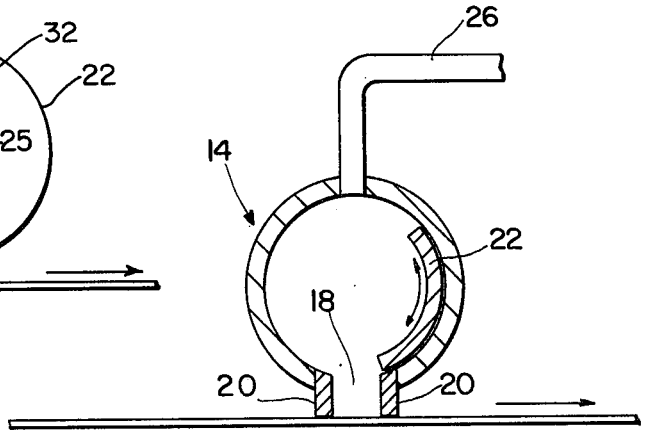
FIG. 2 shows on a larger scale, a cross section through the suction nozzle of the apparatus along line II—II of FIG. 1.

Therefore, it is necessary to remove the rolling liquid after passing through the rolling stand or at least to decrease it to a certain slight thickness. For this purpose, an elongated suction nozzle 14 is provided which consists of two pipe legs 16 mutually connected swivellably in the middle and mutually adjustable thereby at an angle, the outer wall of which has a longitudinal slit 18 at the side pointed toward the rolling material. As FIG. 2 shows, at the longitudinal edges of these slits 18, sealing strips 20 which project against the rolling material, have been attached, of which at least one is a scraping tool.

The pipe legs 16 carry pipe valves 22 closed at their ends with transversely running leading edges 23, by which the longitudinal slits 18 may be more or less covered up by the ends of the legs depending on the rotational position of the pipe valves 22. Valves 24 are rotatable by means of handles 25. In this way, an adaptation of the effective length of the suction nozzle to the variable width of the rolling material is possible. In connection with the closed ends of the pipe valves, the required under-pressure in suction nozzle 14 will be maintained, and the under-pressure may be adjusted by throttle valves (shown schematically at 32 and having an inlet 34 with a controllable cross section) in the closed ends 24 of the pipe valves 22.

At the apex of the legs 16, a suction air line 26 starts out from the top side of the suction nozzle 14, which line leads to a Venturi-nozzle 28, through which compressed air is guided in the direction of the arrow 30. The flow of compressed air produces under-pressure in the suction line 24 required for sucking off the liquid and simultaneously pressing the suction nozzle against the rolling material.

The same apparatus may be attached to the underside of the rolling material, in order to remove or to reduce the liquid on both sides of the rolling material.

It is also possible to dispose corresponding apparatuses on the rollers of the rolling stand in order to clean these continuously of rolling liquid.

What is claimed is:

1. Apparatus for the removal or controlled reduction in thickness of a film of lubricant on a surface of a moving sheet of cold rolled sheet material after cold rolling and prior to winding the sheet into a coil, comprising:

an elongated suction nozzle for removing said lubricant from said surface by suction, at least one longitudinal edge of said nozzle comprising a scraping tool for scraping across the surface of said cold rolled sheet material, said elongated suction nozzle being positioned transversely to the direction of motion of said cold rolled sheet material and being movable relative to said surface; and suction means to provide suction within said suction nozzle, said suction nozzle allowing the suction to press said scraping tool against the cold rolled sheet material with mechanical pressure in direct proportion to the amount of suction applied.

2. Apparatus according to claim 1 further comprising means in said suction nozzle for adjusting the amount of said suction therein to thereby adjust the degree to which said scraping tool is pressed against said surface.

3. Apparatus according to claim 2 wherein said suction adjusting means comprises a suction inlet and means for adjusting the cross sectional area of said inlet.

4. Apparatus according to claim 3 wherein said suction nozzle, viewed in top view of the surface of the cold rolled material being treated, is V-shaped and oriented such that the apex of the V lags, in the direction of motion of said surface, in relation to the ends of the arms of the V-shaped nozzle.

5. Apparatus for the removal or reduction in thickness of an adherent film of liquid from a sheet comprising:

an elongated suction nozzle of which at least one longitudinal edge comprises a scraping tool, said suction nozzle being pointed transversely to the direction of movement of said sheet and which is movable relative to the surface of said sheet, both longitudinal edges of the suction nozzle comprising vacuum sealing strips which sealingly contact said surface, said suction nozzle viewed in top view of the surface to be treated being V-shaped and being oriented relative to the surface of said sheet in such a way that the apex of the V-shaped nozzle lags in relation to the ends of the arms of the V-shaped nozzle, the angle between the legs of the V-shaped nozzle being adjustable; and means for adjusting the vacuum within said suction nozzle, said means having an inlet with an adjustable cross sectional area.

6. Apparatus for the removal or reduction in thickness of an adherent film of liquid from a sheet comprising:

an elongated suction nozzle having a longitudinal opening of which at least one longitudinal edge comprises a scraping tool, said suction nozzle being pointed transversely to the direction of movement of said sheet and which is movable relative to the surface of said sheet, both longitudinal edges of the suction nozzle comprising vacuum sealing strips which sealingly contact said surface, said suction nozzle viewed in top view of the surface to be treated being V-shaped and being oriented relative to the surface of said sheet in such a way that the apex of the V-shaped nozzle lags in relation to the ends of the arms of the V-shaped nozzle;

means for adjusting the vacuum within said suction nozzle, said means having an inlet with an adjustable cross sectional area; and means for changing the effective suction length of the nozzle opening.

7. Apparatus as in claim 6 wherein the legs of the V-shaped nozzle have a circular inside cross section; and wherein said changing means comprises a rotary valve received inside each said leg, said valve having a slanting control surface with respect to the nozzle length for changing the effective suction length of the nozzle opening of said legs.

8. In cold rolling apparatus for cold rolling a metal sheet comprising a rolling stand, means for winding a cold rolled sheet of metal after passing through said rolling stand, and means for removing or reducing the thickness of lubricant from said sheet after passage through said rolling stand and prior to winding the sheet into a coil, the improvement wherein said lubricant removal or thickness reduction means comprises an elongated suction nozzle having an opening of which at least one longitudinal edge comprises a scraping tool, said suction nozzle being pointed transversely to the direction of movement of said sheet and which is movable relative to the surface of said sheet.

9. Apparatus as claimed in claim 8 wherein both longitudinal edges of said suction nozzle comprise vacuum sealing strips which sealingly contact said surface, and wherein said apparatus further comprises means for adjusting the cross sectional area of the suction nozzle inlet.

10. Apparatus as in claim 9 wherein the suction nozzle viewed in top view of the surface to be treated is V-shaped thus having two legs and is oriented relative to the surface of said sheet in such a way that the apex of the V-shaped nozzle lags in relation to the ends of the arms of the V-shaped nozzle.

11. Apparatus as in claim 10, wherein the angle between the legs of the V-shaped nozzle is adjustable.

12. Apparatus as in claim 10, further comprising means for changing the effective suction length of the nozzle opening of said legs of the V-shaped nozzle.

13. Apparatus as in claim 12, wherein the legs of the V-shaped nozzle have a circular inside cross section and receive rotary valves with slanting control surfaces with respect to the nozzle length for changing the effectie suction length of the nozzle opening of said legs.

14. Apparatus as in claim 8, further comprising venturi nozzle means for producing under-pressure in said suction nozzle.

* * * * *